United States Patent [19]

Catanese

[11] 4,309,744

[45] Jan. 5, 1982

[54] ILLUMINATED DECORATION

[76] Inventor: Salvatore S. Catanese, 25 Almount St., Fitchburg, Mass. 01420

[21] Appl. No.: 141,634

[22] Filed: Apr. 18, 1980

[51] Int. Cl.[3] ..... F21V 21/04

[52] U.S. Cl. ..... 362/147; 362/253; 362/311; 362/364; 52/28

[58] Field of Search ..... 362/125, 126, 127, 145, 362/147, 148, 151, 364, 365, 366, 367, 222, 253, 311; 52/28; 312/223; 40/554, 152.2

[56] References Cited

U.S. PATENT DOCUMENTS

| | | | |
|---|---|---|---|
| 2,772,347 | 11/1956 | Lanmon | 362/145 |
| 3,227,061 | 1/1966 | Swaynze | 362/253 |
| 3,303,616 | 2/1967 | Brown | 52/28 |
| 3,477,182 | 11/1969 | Fulton | 52/28 |
| 3,521,047 | 7/1970 | Smith | 362/222 |
| 3,721,050 | 3/1973 | Perina | 52/28 |
| 3,998,025 | 12/1976 | Nestroy | 52/28 |

*Primary Examiner*—L. T. Hix
*Assistant Examiner*—Alan Mathews
*Attorney, Agent, or Firm*—Charles R. Fay

[57] ABSTRACT

A rectangular boxlike member containing a light to be applied to the exterior of a building between studs e.g. at the sides of a door or window; a cover for the box, said cover being connected thereto and having a translucent panel of plastic or glass to emit light, said cover extending for roughly twice the length of the box so that the illumination is aligned with the upper part of the door or window, conforming thereto. The rest of the cover is opaque and extends to the ground level or to the bottom of the door or window.

1 Claim, 4 Drawing Figures

ILLUMINATED DECORATION

BACKGROUND OF THE INVENTION

Many doors and windows are very plain and some doors have glass elongated windows on each side thereof. With no side decoration, a door can be very plain and uninteresting, and it is the object of the present invention to provide for an illuminated decoration for doors or windows that greatly enhances the beauty thereof. At the same time, the Illuminated decoration may be placed in the frames of elongated door side windows, substituting therefore, and providing a little more protection against an intruder being able to break the glass, reach in and turn the door knob for entrance to the house.

SUMMARY OF THE INVENTION

The present invention provides an elongated, generally rectangular box preferably made of aluminum but which may be of any suitable material, including wood and the like. This box has a bottom, end walls, and sidewalls, and has an open top. The box provides for the mounting of any kind of illumination therein, preferably an elongated electric light, or a plurality which can be energized by means of a switch inside the building. This box is mounted between studs prefarably adjacent the door and its dimensions are roughly the same at least vertically as the top part of the door or window.

A covering is provided for the open top of the box, said covering being even more elongated, covering the illuminated box with translucent glass or plastics material, but then extending further down to the ground or the stoop or the bottom of the door or window, as the case may be, improving the decorative effect by being substantially the length of door or window. The extension of the cover is opaque.

PREFERRED EMBODIMENT OF THE INVENTION

Figure 1:
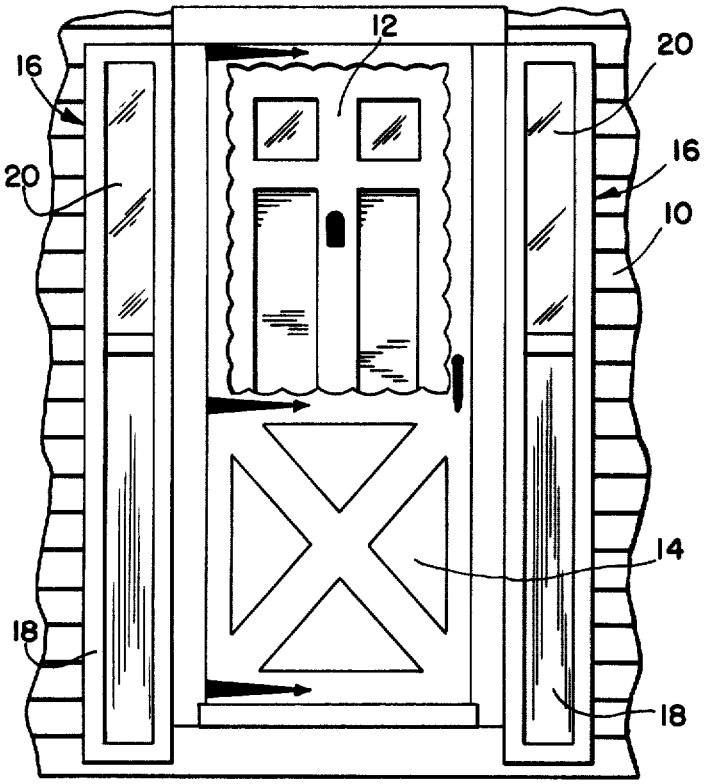
FIG. 1 is a view in front elevation illustrating the invention installed in place.
Figure 3:
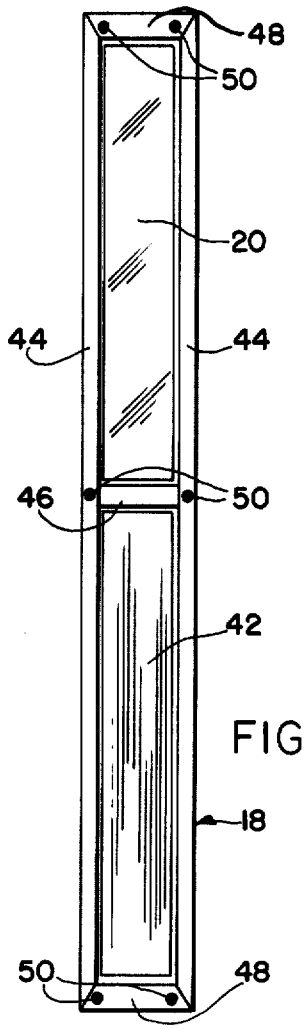
FIG. 3 is a front view of the cover on an enlarged scale.

Refer to FIG. 1, there is shown a door and its area in a building such as a house 10. This house has a front door 12 in an appropriate opening in a wall, as usual and in this case there is also a storm door 14. The storm door is windowed in the top portion thereof. As far as the present invention is concerned, the presence of the storm door is not of importance, but a little better idea of the decorative effect of the present invention is believed to be derived. If the invention is applied to a window also in an appropriate wall opening, as as usual, it should be remembered that most windows have bottom and top construction, e.g. double hung windows At each side of this door assembly and its wall opening, there is provided an illuminated decoration generally indicated by the reference numeral 16. There is one decoration at each side of the door and the purpose is to enhance the appearance of the entrance or window.

Each of the decorations, as shown in FIG. 1, includes a cover 18 which has a lower opaque portion 42 and an upper window portion 20, the window preferably being translucent but not transparent, and in some cases colored, rippled, or having any kind of decorative effect desired. Behind these translucent windows 20, 20, there is provided an illumination which may be of any well known kind, such as, a regular incandescent bulb or an elonated bulb as shown in FIGS. 2 and 4 at 22.

In the installation of the present decorative appliance, the front wall as at 24 of the outside wall of the building is cut away to expose studs e.g. 26. This exposure need only be from a top area at 28 to the bottom area at 30 and if necessary it is built in on the side edges thereof for reception of the illuminated box generally indicated at 31.

Figure 2:
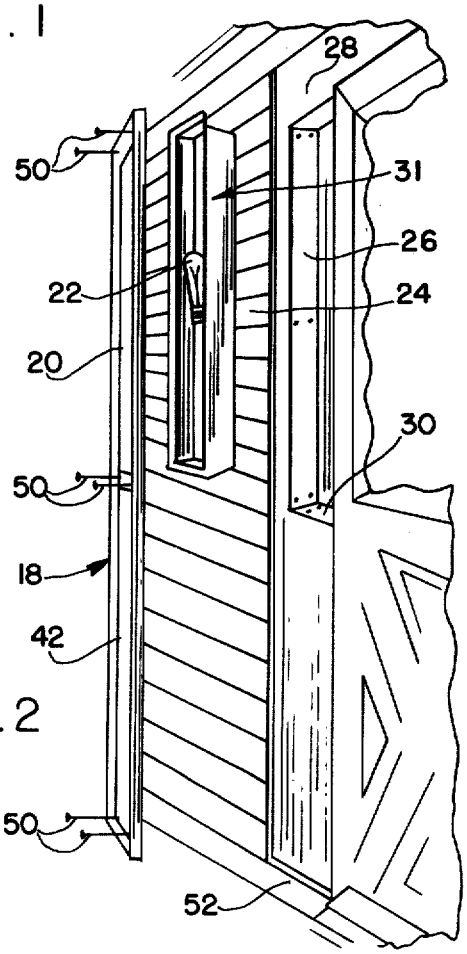
FIG. 2 is an exploded perspective view illustrating the construction of the invention and the method of assembling the same with respect to the building to which it is to be applied.
Figure 4:
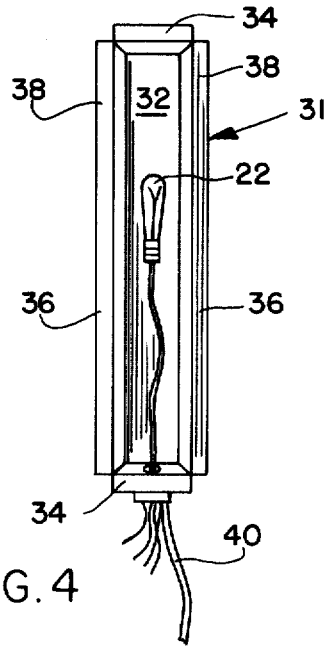
FIG. 4 is a front view of the illuminated box, also on an enlarged scale.

This box may be made up in any way desired but it is provided with a bottom 32, end walls 34, side walls 36, and has an open front or top as shown in FIGS. 2 and 4. This box is fastened in position between the studs 26 and is generally flush as to the outstanding flanges 38 with the outer wall of the building. As stated the lamp 22 may be of any kind desired and is provided with energizing wires or the like as at 40 which may extend within the building and there provided with an on/off switch.

When this box is in position in its recess, the cover generally indicated at 18 is applied. This cover comprises an elongated member which has an upper portion with window 20 and a which has a lower opaque panel 42. As an integral part thereof, side members 44, 44, provide an opening for window 20 which is mounted in place therein, located by a generally central cross member 46 and the upper end member 48, The window 20 in general conforms to the configuration of the box 30 as shown in FIG. 4 and is applied to cover the same as shown in FIG. 2 by any desired means. Screws or other fasteners 50 may be used to secure the entire cover 18 in place.

In some cases, the exterior surface of the wall may be clapboard, shingles or the like, which will be removed from the bottom portion 52 area of the numeral 30, FIG. 2, so that the entire device is, in effect, recessed into the wall with box 31 set into the wall but not all the way through.; The cover may be applied to the outside of the house so that the entire cover extends slightly outwardly from the wall and only needs a little caulking to seal it in position. The lower opaque panel 42 of the cover 18 registers with and conceals the area between the numerals 30 and 52 in FIG. 2, and the entire decoration is generally co-extensive in length with the opening that accommodates the door or window as the case may be.

I claim:

1. An ornamental structure for the exterior wall of a building comprising in combination an opening in said wall, said opening accommodating a conventional closure, a recess in the exterior wall only adjacent and parallel to the opening, said recess being rectangular and arranged vertically and having a length approximately the same as the opening, said recess being deeper at its upper part than in the lower part thereof, and a cover for said recess, said cover being elongated and rectangular and completely covering the recess, said cover including a lower portion which is opaque and an upper portion including a window, said cover extending from the bottom to the top of said recess, said cover being approximately the height of the opening, a box having the general dimensions of the window, said box being inserted and confined in the deeper part of the recess, and a source of illumination in the box, said box having an open side facing and being coextensive with the window.

* * * * *